US007267498B2

(12) United States Patent
Cahill et al.

(10) Patent No.: US 7,267,498 B2
(45) Date of Patent: Sep. 11, 2007

(54) SIX-SIDED PRINTING METHOD

(75) Inventors: Daniel Paul Cahill, Verona, KY (US); Robert Andrew Kosieniak, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 45 days.

(21) Appl. No.: 11/325,985

(22) Filed: Jan. 5, 2006

(65) Prior Publication Data

US 2007/0154250 A1 Jul. 5, 2007

(51) Int. Cl.
*B41J 5/30* (2006.01)

(52) U.S. Cl. ..... 400/62; 101/483; 358/2.1

(58) Field of Classification Search ..... 400/61, 400/62, 76, 24; 358/2.1, 2.99; 101/483, 101/476

See application file for complete search history.

(56) References Cited

U.S. PATENT DOCUMENTS

| | | | | |
|---|---|---|---|---|
| 4,427,290 | A | 1/1984 | Kaye et al. | 355/40 |
| 4,949,999 | A * | 8/1990 | Ke-hui | 283/38 |
| 5,016,191 | A * | 5/1991 | Radochonski | 345/596 |
| 5,085,417 | A | 2/1992 | Copham | 270/1.02 |
| 5,243,394 | A | 9/1993 | Matsuno et al. | 399/2 |
| 5,715,382 | A * | 2/1998 | Herregods et al. | 358/1.18 |
| 5,717,976 | A | 2/1998 | Chowdry et al. | 399/45 |
| 5,940,582 | A * | 8/1999 | Akabori et al. | 358/1.13 |
| 6,048,114 | A | 4/2000 | de Troz | 400/24 |
| 6,335,084 | B1 * | 1/2002 | Biegelsen et al. | 428/192 |
| 6,478,337 | B1 | 11/2002 | Toda et al. | 283/38 |
| 6,499,665 | B1 | 12/2002 | Meunier et al. | 235/487 |
| 6,582,138 | B1 | 6/2003 | Meunier et al. | 400/103 |
| 6,585,163 | B1 | 7/2003 | Meunier et al. | 235/487 |
| 6,601,507 | B1 | 8/2003 | Mallok | 101/368 |
| 6,604,875 | B2 | 8/2003 | Meunier et al. | 400/103 |
| 6,637,666 | B2 | 10/2003 | Meunier | 235/494 |
| 6,659,506 | B1 * | 12/2003 | Erisalu | 283/36 |
| 6,820,815 | B2 | 11/2004 | Meunier et al. | 235/487 |
| 6,874,774 | B2 * | 4/2005 | Todie | 270/5.02 |
| 2003/0016980 | A1 | 1/2003 | Meunier et al. | 400/76 |
| 2003/0127523 | A1 | 7/2003 | Meunier et al. | 235/487 |

* cited by examiner

*Primary Examiner*—Ren Yan
(74) *Attorney, Agent, or Firm*—Frederick H. Gribbell, LLC

(57) ABSTRACT

An improved sheet printer is provided capable of simultaneously printing both on a "main" surface of a sheet of print media and along edges of that same sheet of print media, such that when the sheets are stacked after being printed, a predetermined image will appear along one or more of the sides of the stack. The "side image" is formed by the dots that have been printed along the edges of the individual sheets. The side image is generated during image processing of the print job, not by a post-processing step of marking or printing against the side of a stack that has already been printed. The printer can form the side images by printing along all four edges of a single piece of the sheet media, and also on one of that sheet's main surfaces, during a single pass through a printing station.

22 Claims, 6 Drawing Sheets

SIX-SIDED PRINTING METHOD

TECHNICAL FIELD

The present invention relates generally to image forming equipment and is particularly directed to printers of the type which print along edges of sheet media. The invention is specifically disclosed as a printer that simultaneously prints both on a "main" surface of a sheet of print media and along edges of that same sheet of print media, such that when the sheets are stacked after being printed, a predetermined image will appear along one or more of the sides of the stack, and this "side image" is formed by the dots that have been printed along the edges of the individual sheets.

BACKGROUND OF THE INVENTION

Most conventional sheet printers, when printing on the front surface or back surface of sheets of print media, require a margin along all four edges. This conventional method prevents printing along the edge of such sheets of print media except by use of a secondary post-processing operation. Some conventional printing systems will print in a post-processing step from the side of a stack of sheets, so as to print some type of edge marking along those sides.

Other conventional sheet printers will print along the surface of a sheet of print media, and a later trimming step will be performed to allow some of the printed material to end up in a position right along the edge of the sheet. Of course, in such printing systems, the "edge portion" of the printed material is positioned along a "trimmed edge."

Still other conventional sheet printers can print on the surface of a sheet of print media near the edge of that same sheet of print media, however, many of those printers merely create linear bars or rectangles along the planar surface near the side edge, in some cases these are to have the appearance of a bar code. Such printers are not designed to allow graphic design images, or custom images to be printed along the edges of a stack of sheet media, so as to produce a pattern that creates a customized image or other type of graphic design image in the stack when viewed from the side of that stack.

Conventional printing presses that use flat "plates" or cylindrical rolls (with bent "plates") are typically capable of printing at virtually all locations on sheets or on a continuous roll of print media, but these machines use very different structures and processes to create the "image data" on those plates or rolls. Most of them use single (or multiple) plates with physical holes in the plates for the printing ink to flow therethrough, to the print media. Moreover, such presses handle their print media in very different ways than sheet printers, such as a laser printer or ink jet printer.

SUMMARY OF THE INVENTION

Accordingly, it is an advantage of the present invention to provide a printer that is capable of printing on both the main surfaces (or faces) of sheets of print media, as well as printing on one or more of the edges of that same set of sheets of print media, such that when a multi-page print job is stacked, the edge data will appear as an image when viewed from the side.

It is another advantage of the present invention to provide a printer and methodology capable of producing edge data on at least one edge ("edge printing") of various sheets of a multi-page print job and for printing also on the main surfaces ("face printing"), in which the edge data is integrated into the normal bitmap data for printing on the face or main surface of the sheets of the multi-page print job.

It is yet another advantage of the present invention to provide a methodology by which edge data and surface data for a multi-page print job can be integrated and printed on multiple pages, and when those pages are stacked after passing through a printer, the edge data will appear as side images along one or more sides of the stack of sheet media, in which the images along the sides can be determined or designed by a user, or the user can use factory graphics for the side images.

It is still another advantage of the present invention to provide a methodology for printing on both the large face surfaces of sheet media and also the edges of that sheet media, so that the edge-printed side images will appear on the sides of a stack of sheet media for a particular print job, and in which the user determines the orientation of the side image data.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a method for printing edge data using a printing apparatus is provided, in which the method comprises the following steps: (a) providing a sheet printing apparatus having a print media input device, a printing station that applies image-forming material to a sheet of print media that is supplied by said print media input device, and an output pathway that directs said sheet of print media to an output area; (b) receiving a print job at said sheet printing apparatus, said print job including face image data that forms a first bitmap image on a surface of said sheet of print media, said print job also including edge image data that forms a second bitmap image along at least one edge of said surface of the sheet of print media; (c) integrating said first bitmap image and said second bitmap image into a single overall bitmap image data that is to be used for printing on said surface of the sheet of print media; and (d) moving said sheet of print media from said print media input device to said printing station and, according to said single overall bitmap image data, applying said image-forming material to said surface of the sheet of print media; wherein: (e) said second bitmap image is sufficiently small in width along said at least one edge of the sheet of print media that it is not highly visible when viewed from said surface of the sheet of print media; and (f) when said sheet of print media is stacked with other sheets of print media that are printed in the same print job, said second bitmap image forms at least a portion of a side image that is discernable when the stack is viewed from a side.

In accordance with another aspect of the present invention, a method for printing edge data using a printing apparatus is provided, in which the method comprises the following steps: (a) providing a sheet printing apparatus having a print media input device, a printing station that applies image-forming material to a sheet of print media that is supplied by said print media input device, and an output pathway that directs said sheet of print media to an output area; (b) receiving a print job at said sheet printing apparatus, said print job including face image data that forms a first bitmap image on a surface of said sheet of print media, said print job also including edge image data that forms a second bitmap image along at least two edges of said surface of the sheet of print media; and (c) moving said sheet of print media from said print media input device to said printing station and, in a single pass through said printing station, applying said image-forming material to said surface of the sheet of print media, incorporating both said first and second bitmap images; wherein: (d) when said sheet of print media is stacked with other sheets of print media that are printed in the same print job, said second bitmap image forms at least a portion of at least two side images that are discernable when the stack is viewed from a first side and from a second side.

In accordance with yet another aspect of the present invention, a method for printing edge data using a printing apparatus is provided, in which the method comprises the following steps: (a) providing a sheet printing apparatus having a print media input device, a printing station that applies image-forming material to a plurality of sheets of print media that are supplied by said print media input device, and an output pathway that directs said sheets of print media to an output area; (b) receiving a print job at said sheet printing apparatus, said print job including face image data that forms a first bitmap image on a surface of at least one of said plurality of sheets of print media, said print job also including edge image data that forms a second bitmap image along at least one edge of a surface of at least one of the plurality of sheets of print media; (c) processing said face image data and said edge image data for said plurality of sheets of print media of said print job; and (d) moving said plurality of sheets of print media from said print media input device to said printing station and, according to said first bitmap image and said second bitmap image, applying said image-forming material to said surface of the plurality of sheets of print media; wherein: (e) when said plurality of sheets of print media are stacked with one another, said second bitmap image forms at least a portion of a side image that is discernable when the stack is viewed from a side; and (f) said second bitmap image comprises a design that is determined in real time during said processing step of said print job.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
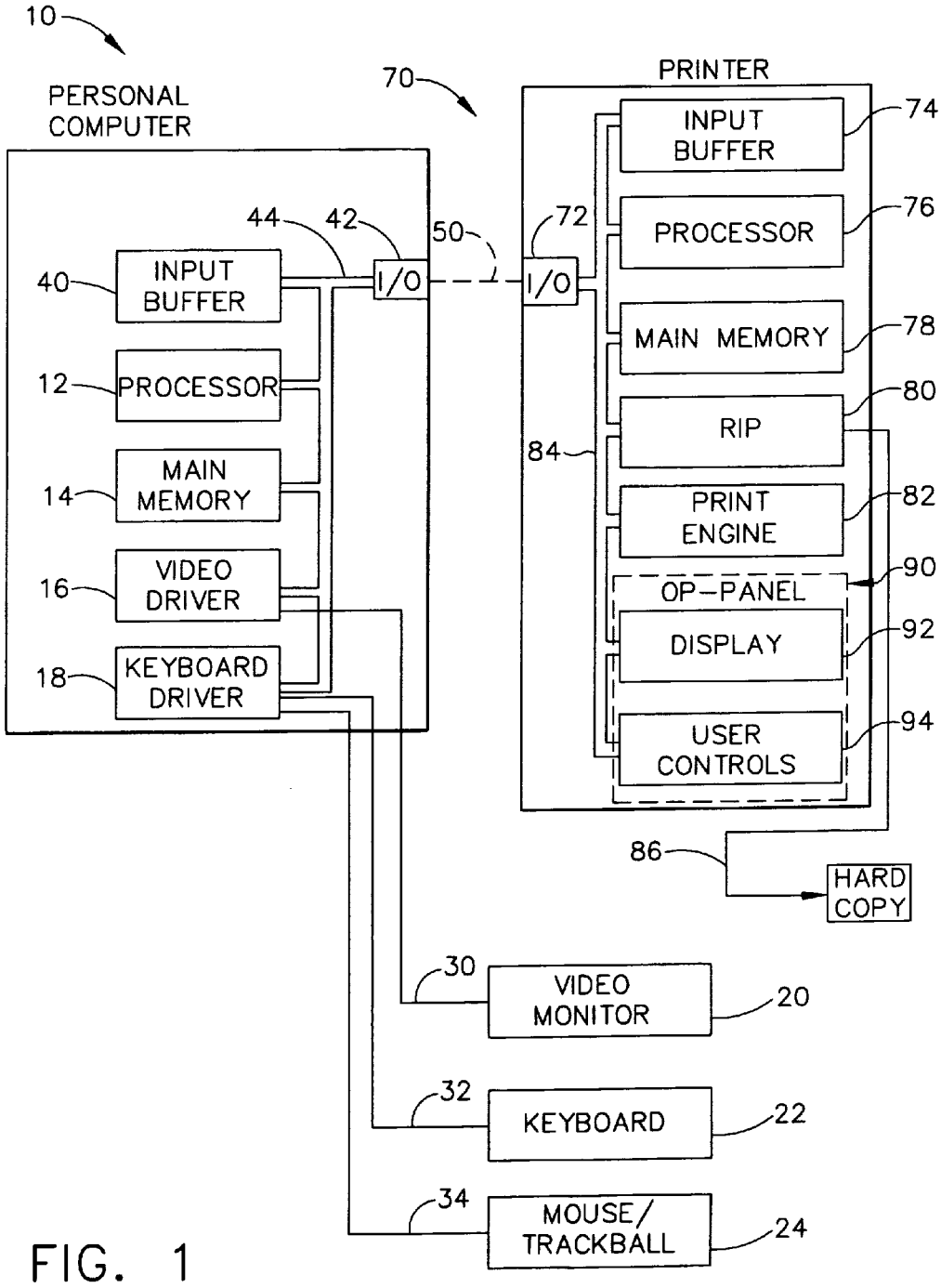
FIG. 1 is a block diagram of some of the major components used in the present invention, including a personal computer and a printer.

Reference will now be made in detail to the present preferred embodiment of the invention, an example of which is illustrated in the accompanying drawings, wherein like numerals indicate the same elements throughout the views.

The present invention relates to printers that can print at, or very close to, the edge of a sheet of paper, such that the printed ink or toner (as "edge image data") is visible when viewed from the edge of the sheet. The term "edge" as used in this patent document generally refers to a portion of the outermost perimeter of a planar sheet of print media; typically a single edge consists of a linear segment along this perimeter. One aspect of the invention is to control these "edge dots" so that, once a set of sheets is resting in the output tray, the sheet edge data will produce a distinctive pattern when viewed from that edge. (See FIGS. 3-6 as examples of this.) Of course, the printer must have the capability to actually place dots right at (or very near) the edge, without requiring some blank distance that otherwise would act as a margin.

The pattern that is to be produced along the edge of the pages is broken into "page lines," in which an edge of each sheet that will be printed will comprise one of these page lines. When several sheets are stacked in the output tray (or bin), the individual page lines are thereby grouped together to produce a predetermined pattern that is visible from that edge, but is not highly visible when viewed from the front or back of the individual sheet. The edge image data essentially is quite narrow in width to keep it from distracting the reader of the "main" surface of the printed document; the width of the edge image data may be only two dots, or perhaps a single dot, in size.

In one mode of the invention, this "edge" data pattern is integrated with the "normal" print job data that is planned for each individual sheet, and the edge data would be located in the margin area for most conventional print jobs. The "normal" print job data constitutes "face image data" that will be printed as a bitmap on the "main" surface of the sheet of print media, which is substantially performed by conventional methodologies used today in various modern printers.

The present invention prints the "edge" dots as part of a print job that is also simultaneously printing on either the front surface or back surface of a sheet of print media. In other words, the present invention does not perform a "post-processing" step of later printing (or otherwise "marking") from the side of a stack of sheets of print media, that otherwise would need to occur after an earlier "normal" print processing step of printing on the front and/or back surfaces of those same sheets of media, and then placing these sheets of media in a stack so that the post-processing step could then be performed. In an exemplary embodiment of the present invention, the face image data and the edge image data are integrated into a "single overall bitmap image data" by the image processing device, so that one (or more) edges will be printed during the same printing pass (through the printing station) that one of the faces (or "main" surfaces) of a single sheet of print media is printed. This aspect of the present invention will be discussed in greater detail below.

The present invention has several possible uses: (1) print a user's name; (2) print a "Confidential" stamp; (3) print a bar code; (4) print a color, along the entire edge, or a major portion of the edge; (5) print a company name, or logo; (6) print an image along the edge, such as line art, or possibly gray level contones; (7) print an arrow (or other) pattern with (proximal to) a number, in which the arrow points to the first page of a chapter within the stack of print media. Certainly additional uses are possible within the scope of the present invention; moreover, multiple permutations and combinations of the above listing are possible, including in combination with other additional uses.

As noted above, the present invention will print along the edges of a page of sheet media such that when a stack of the sheet media is observed from the side, a graphic image or customized text can be displayed. The present invention takes the edge data and breaks it into "page lines" that are similar to "scanlines" that make up the bitmaps of printed images in most modem printers. As such, a single pageline represents a portion of the image that will be created along the edge of a single sheet of print media. When a multiple-page print job is processed, the sheets that are to have dots placed along the edges of predetermined single sheets of paper in the print job will be processed as part of the overall print job for either the front surface or the back surface (or perhaps both) of that sheet of print media. Each of the sheets in the stack that represents the entire print job will be printed with their appropriate pageline data, and upon completion of the print job, a predetermined image will be observed from the side of the printed stack of paper.

As will be discussed in greater detail below, the present invention can make the edge image orientation "right side up" in the output stack of papers, or it can make the image oriented "upside down." Moreover, the edge images along the sides of the output stack of papers can be oriented at a 90° angle as compared to the "right side up" or upside down types of images. These possibilities are discussed below and illustrated in this patent document.

The edge image data will be placed along the actual edges of the sheet of print media, and will comprise a very narrow row or column of dots made of either toner or ink (for a laser printer or an ink jet printer, for example). This edge image data is not highly visible when viewing the front or back of the individual sheets of print media, and thus the edge image data is not distracting. When the edge data is printed along the sheet media edges, it will tend to bleed over the edge (when printing with ink or toner, for example) and thus be visible from the edge, particularly so that a stack of sheets so printed will create a "side image" that is discernable when viewed from that side of the stack.

Some of the advantages of the present invention are that the edge data will undergo image processing in an integrated manner, and will be printed along with the normal front or back surface print data, and thus time will be saved by not requiring a post-printing procedure solely for the edges themselves. When documents have edge coding printed thereon, it can make finding the appropriate documents easier. Edge coding of documents that use color coding, or perhaps a type of bar coding can make individual pages easier to associate with a document if those pages have become separated. For example, when a loose sheet that has edge data printed thereon is inserted into the document in the wrong place, the edge image would tend to show a discontinuity. Another advantage is that multiple documents that have been printed and placed within the output bin of a shared printer will be more easily found by the appropriate user, when that user comes to the printer to pick up his or her print job. For example, a print job that has a bar code printed thereon could be scanned without removing the multi-sheet print job from a file folder. This could also be true for other types of codes that may not necessarily rely on traditional bar code-type markings, in which the user's name (for example) comprises the edge data.

Another possible use is placing markings in color along the edge of a stack of print media, which could be used with a color laser printer or a standard color ink jet printer. In this manner, sheets could be color-coded as "separator sheets" without the need to stock different colored papers. This would be more economical than some of the practices in conventional printing systems. The use of "chapter locators" in thick documents can be implemented using the edge markings of the present invention. Arrows or other shapes with chapter numbers nearby can be used, in which the arrows (or other shapes) can point to the first page of a chapter; or the arrows could have the shape of a pyramid, in which either the tip or the base of the pyramid represents the first page of a chapter. This could replace the small cutouts in pages of dictionaries, for example.

Referring now to FIG. 1, a hardware block diagram is provided showing some of the major components that can be used in the present invention. One component in FIG. 1 is a personal computer, generally designated by the reference numeral 10. The personal computer ("PC") 10 will typically include multiple input/output (I/O) circuits, including the circuit 42 on FIG. 1. The signals passing through the I/O circuit 42 will typically pass through a set of signal and command lines, which could also have address lines connected thereto. All of these data, address, and command lines could be grouped as a bus, such as the bus 44 depicted on FIG. 1.

In PC 10, the I/O circuits are connected to an input buffer 40, which may be part of the system main memory, which is depicted at the reference numeral 14. A typical PC will have a microprocessor, depicted on FIG. 1 by a processing circuit 12. A typical PC will also have a video driver circuit 16 and a keyboard driver circuit 18. All of these devices typically are appropriately connected to one another by bus 44.

A typical PC will have a video monitor 20, a keyboard 22, and a pointing device 24, such as mouse or a trackball. Video monitor 20 is connected to the video driver circuit 16 over a signal line 30. Keyboard 22 is connected to the keyboard driver circuit 18 by a signal line 32. The mouse/trackball 24 is connected to some type of pointing driver circuit over a signal line 34. The mouse/trackball 24 may interface to a separate driver circuit, or perhaps to the keyboard driver circuit 18, particularly if the PC 10 is some type of portable device, such as a laptop or a palm pilot, for example. These are well-known interface circuits and hardware components.

A second element of the present invention is a printer, generally designated by the reference numeral 70. Printer 70 has an input/output circuit 72, an input buffer 74, a processing circuit 76, and a memory circuit 78. In addition, many printers have a processing capability known as "raster image processing," which is also referred to as a "RIP processor," designated by the reference numeral 80 on FIG. 1. Most printers also have a print engine processing circuit, designated by the reference numeral 82 on FIG. 1. It will be understood that the RIP processor 80 and the print engine processor 82 can be separate processing devices, or they could perhaps be both in one larger processing circuit, which may also include the processor 76 on FIG. 1. Many printers use Application Specific Integrated Circuits (ASICs) to contain logic elements, input/output elements, memory elements, and even a processing circuit, all within one device. As ASICs become more powerful, the more likely that virtually all of the circuits described above will be contained in a single ASIC. On the other hand, many printers are designed with separate print engine circuitry, for ease of manufacture. It will be understood that the input buffer 74 could be part of a larger main memory circuit, such as the memory 78. On the other hand, the input buffer 74 could be a separate, dedicated set of memory elements or buffers. Most or all of the main hardware elements could be connected to each other via a bus 84, containing data, address, and command lines.

A typical printer 70 will include some type of print media input device, such as an input paper tray, that feeds sheets of print media to a printing station, such as a print engine of a laser printer or a printhead of an ink jet printer. (On the other hand, the print media input device could merely be a hand-fed opening in the printer's housing.) The printing station will apply some type of image-forming material to the sheets of print media, as that print media passes through the printing station. In many modern sheet printers, the image-forming material will be toner (for most laser printers), ink (for ink jet printers), or some other colorant material such as colored wax for some modern jet-type or nozzle-type printing devices. For the purposes of this patent document, all references to a print engine or printhead will also encompass other types of printing station devices, including those that dispense toner, ink, wax, or other compounds or materials that could be developed in the future. Moreover, the principles of the present invention apply both to monochrome printers and multi-color printers.

After the sheets of print media pass through the printing station of printer 70, the sheets will be directed to an output pathway. A typical output pathway will lead to an "output area," such as an output paper tray, or a surface of the printer's housing where the sheets of print media will end up, essentially in a stack. This form of output pathway is designated by the reference numeral 86 on FIG. 1. Note that the output pathway could be a flat surface, horizontal or otherwise; or the output pathway could be a curved surface. Moreover, the output area could only partially support the stack of print media where the sheets stop moving, and a portion of the sheets could be suspended in mid-air (typically at the "open end" of the stack from the printer's exit port).

A second type of output pathway could lead to a "duplexing station" that can flip the sheets of print media to their opposite side and then send the sheets back through the printing station so that their opposite side may be printed. Such duplexers are common in many modern laser printers, and could be provided in virtually any type of printing apparatus. The use of double-sided printing is thus a conventional methodology, and the present invention can use duplexing operations in a new way, as discussed below in greater detail.

Most printers have some type of operator panel, which is generally designated by the reference numeral 90 on FIG. 1. In a typical printer, the op-panel 90 will include some type of display 92 and set of user controls 94. In many printers, the display 92 is a relatively inexpensive LCD device that has multiple rows and columns of alphanumeric characters. As displays become more powerful and less expensive, then a graphical display could be used on a printer, even including a display with full three-color capabilities. The user controls are typically a set of push buttons, and may include some type of pointing device, such as a cursor control, which could be particularly useful if the display 92 is a graphic display.

It will be understood that the printer 70, and personal computer 10 could have many more components than described above, or perhaps could be missing some of the circuits described above, while still falling within the principles of the present invention. Some of the functions that are performed in the present invention could be performed by either the PC 10 or the printer 70. Both devices typically have image processing capabilities, although the present trend is to have the more time-intensive processing functions performed by a PC (including laptops or palm pilots, for example), which will allow a printer to use a less powerful (and hence less expensive) processing circuit.

Usually a printing system requires a "source" to originate a print job, and that source often is a PC or other processing device. (It could be a Fax machine, or a copier, for example, that can output an image to a PC, and/or to a printer.) While printers can produce certain images without any outside data source, such internally-produced images tend to be "test" images when setting up the printer, for example. When an external image source is used, the data must be communicated to the printer; in FIG. 1 a data cable 50 is used to communicate between PC 10 and printer 70.

It will be understood that the communications link can be in many forms, such as a parallel printer cable, a USB cable, or even a non-contact optical transmission/reception system (using modulated infrared light, for example). In modern printers, a typical input port could be a USB port or a network ETHERNET port, but also other types of ports can be used, such as parallel ports and serial ports. The input buffer 40 can be part of the overall system RAM of the main memory 14, or it can be a separate set of memory elements or data registers, if desired. A print job arriving at printer 70 could thus come from a dedicated PC (such as the PC 10), or from a PC sending print data over a communications network, or from a network server over a communications network, for example.

It will also be understood that the printer 70 will not necessarily need all of the processing circuits that are depicted on FIG. 1. For example, some of the processing for the RIP processor 80, and even for the print engine 82, could be performed on the PC 10, and the RIP processor 80 and print engine processor 82 would essentially become virtual processors with respect to the printer's hardware components. Much of the control logic needed for controlling the functions of the printing process and the sheet media movements of a printer can be off-loaded to a physically separate processing circuit, or to a virtual processing device. For example, a host computer could send appropriate command signals directly to output switching devices (e.g., transistors or triacs) that reside on the printer main body; the host computer could also directly receive input signals from various sensors on the printer main body, to facilitate the control logic that is resident on such a host computer. Thus the control logic (or a portion thereof) of a printing device need not always be part of the physical printer, but may be resident in another physical device, or perhaps be virtual. In reference to FIG. 1, the processor 76 may not have to reside within the printer 70, but instead could be replaced by a set of electrical or optical command signal-carrying and data signal-carrying pathways (e.g., a set of parallel electrical conductors or fiber optic channels). All of these options are contemplated in the present invention.

Figure 2:
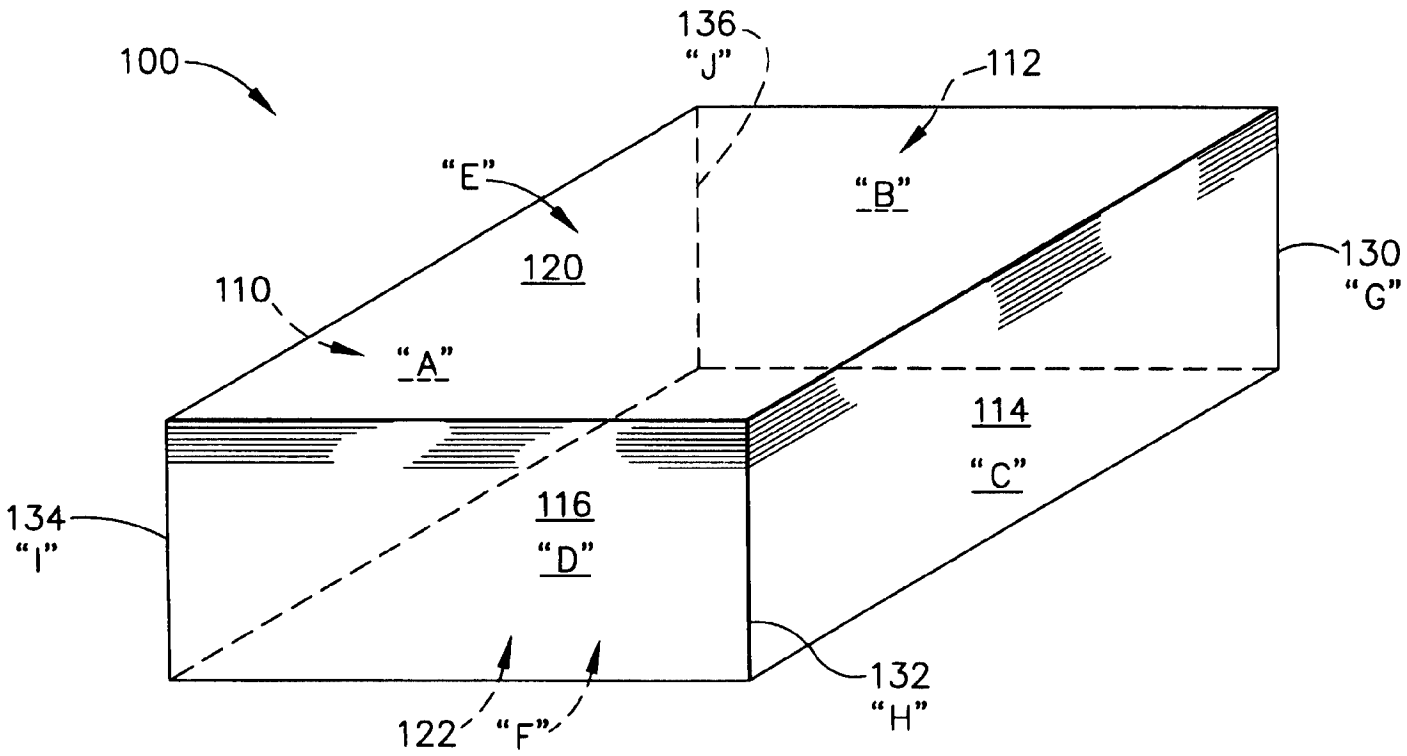
FIG. 2 is a perspective view from above and the side of a stack of sheet media that has been printed, using the image processing functions according to the principles of the present invention.

Referring now to FIG. 2, a stack of printed sheet media is generally represented by the reference numeral 100. The top-most sheet has a front surface at 120, which is also designated by the letter "E". This surface E represents the large face or surface of the top sheet of print media, and each of the sheets of print media will have such a front surface E; on FIG. 2, the top-most sheet in this view is the one designated by the reference numeral 120. Similarly, the bottom-most sheet of print media has a back surface designated by the reference numeral 122, and this is also referred to as the surface "F". Each of the sheets in the stack 100 has a back surface F, and in FIG. 2, it is the bottom-most sheet that is designated by the reference numeral 122. It will be understood that both of the large surfaces of each of the sheets that make up the stack 100 can be printed on both the front surfaces E and the back surfaces F, although many print jobs are only one-sided jobs, and would typically be printed only on the front surface E, or the back surface F.

The sides of the stack 100 are also designated by letters and reference numerals in FIG. 2. These sides represent the multiple edges of the individual sheets of print media that make up the stack 100. The far "left" side in this view is designated by the reference numeral 110, and is referred to as the side "A". This side is not directly visible in the view of FIG. 2, which is the reason for the dashed lines for reference numeral 110. If one of these sheets of print media were placed on a desk, this would be the left vertical edge of that sheet. The "top" side of the stack is designated by the reference numeral 112, and this is referred to as side "B". Again, if one of these sheets of print media were placed on a desk, this would be the top horizontal edge. The right-hand side in FIG. 2 is designated by the reference numeral 114, and this is side "C". If a sheet of this stack were placed on a desk, this would be the right vertical edge. And finally, the nearest side in the view of FIG. 2 is the bottom side designated by the reference numeral 116, and this is referred to as side "D". If one of these sheets were placed on a desk, this would be the bottom horizontal edge.

As can be seen from the above description and the view of FIG. 2, each of the sides A, B, C, and D represent one of the four planes that are perpendicular to the surfaces E and F of the stack of sheet media. Each of these sides A-D comprises the multiple edges of the sheets of print media that constitute the stack 100.

Each of the corners of the individual sheets in the stack 100 will be placed upon one another as the stack is formed. These corners end up comprising a line segment in essence, and these lines segments are designated by the reference numerals 130, 132, 134, and 136 on FIG. 2. These four line segments will also be referred to herein as "corner segments." Each of these corner segments is also designated by a letter, in which corner segment 130 is designated "G", corner segment 132 is designated "H", corner segment 134 is designated "I", and corner segment 136 is designated "J". The corner segments increase in length or size as the number of sheets in the stack 100 increase, whereas the dimensions of the individual surfaces do not increase. Of course, the size of the rectangle that makes up each of the sides A-D will also increase as the size of the stack (and consequently the size or length of each of the corner segments) increases.

Figure 3:
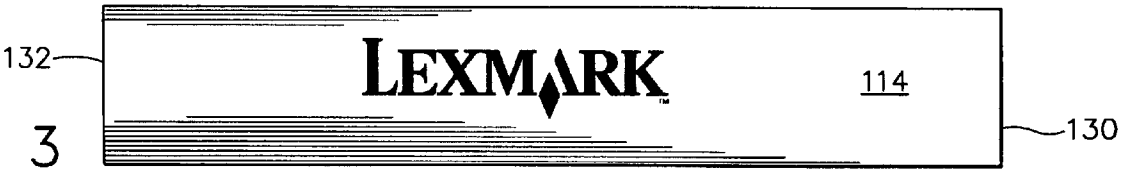
FIG. 3 is a side view of the right-hand side "C" of the stack of sheet media of FIG. 2, showing a factory graphic printed thereon as edge data.

Referring now to FIG. 3, a side view of a stack of sheet media is depicted, in which the right-hand side 114 is illustrated, which is bounded by the corner segments 130 and 132. In FIG. 3, a logo "LEXMARK" is printed along the side, as edge data. As described above, the word LEXMARK is made up of individual pageline data that is placed on individual multiple sheets of print media, and when they are stacked together to form the overall stack 100 of sheet media, the image thereby created has the appearance of the word LEXMARK.

Figure 4:
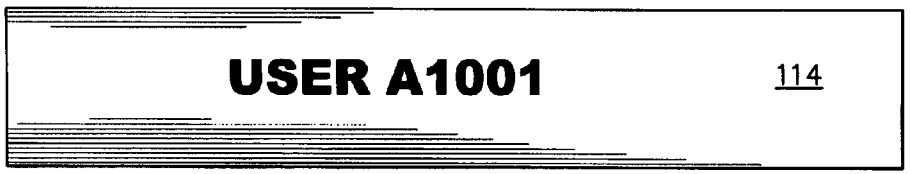
FIG. 4 is a side view of the right-hand side "C" of the stack of sheet media of FIG. 2, showing a user-defined graphic printed thereon as edge data.

Referring now to FIG. 4, a similar view is depicted of the stack's right-hand side 114, and in this instance a user-defined designation has been printed along this side as edge data. In FIG. 4, the image that is visible is "USER A1001" which can represent a single person that uses a particular shared printer over a network, for example. Of course, since a user can define his or her own designation, the actual letters and numbers used can be of any combination selected by such user, and this designation user A1001 is merely a simple example of that capability.

Figure 5:
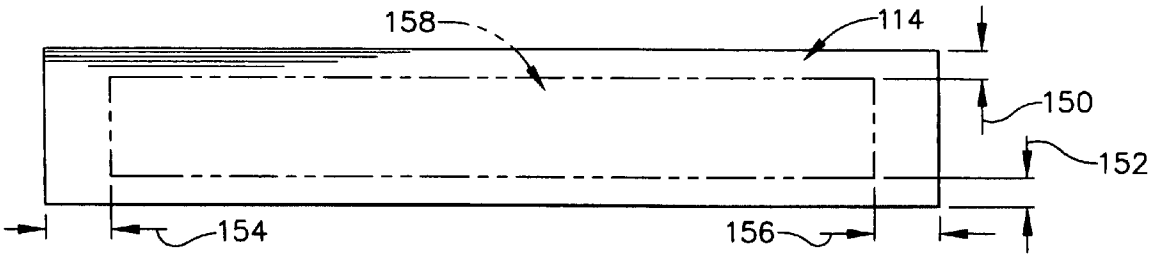
FIG. 5 is a side view of side C of the stack of sheet media of FIG. 2, showing the stack margins and left and right margins of the edge data for side C.

Referring now to FIG. 5, another stack of sheet media is illustrated, and once again it is the right-hand side 114 that is illustrated. In this illustration, there are "margins" designated by reference numerals 150, 152, 154, and 156. These margins can be user-selectable, if desired. In this instance of FIG. 5, the word "margin" is not referring to the empty space that is not printed along the main surface of a sheet of print media. Instead, the margins 150 and 152 represent a top and bottom "stack margin" that represents the number of sheets at the top and bottom, respectively, along the side surface 114 that are not printed along their edges. This value could be user-selectable, and the margins could be zero sheets in size, if desired.

The "left" and "right" stack margins 154 and 156 are also potentially user-controlled in size, and these margins are similar to the left margin and right margin of a typical print job that will be printed on the main surface of a sheet of print media. For the "left" margin 154 and the "right" margin 156, these are not the same thing as top and bottom stack margins as described above, which represent the top or bottom margins that constitute sheets that have no edge printing whatsoever. Instead, the left and right stack margins 154 and 156 represent portions along the edge of the individual sheets of print media where no edge data is placed intentionally, but there can be some edge data printed on these sheets. This leaves a rectangle inside the overall larger rectangle that represents the physical stack of sheets. This inner rectangle is designated by the reference numeral 158, and thereby represents the "side area" in which edge data can be printed. Once again, if the user decides that the margins are to be zero in size, then the inner rectangle 158 would have the same dimensions as the overall size of the sheets of print media, i.e., the side 114. It is assumed that most users will choose to have some type of top and bottom stack margins (150 and 152) and left and right stack margins (154 and 156) for many applications using the edge printing methodology of the present invention. Of course, this stack margin concept is not a requirement.

Figure 6:
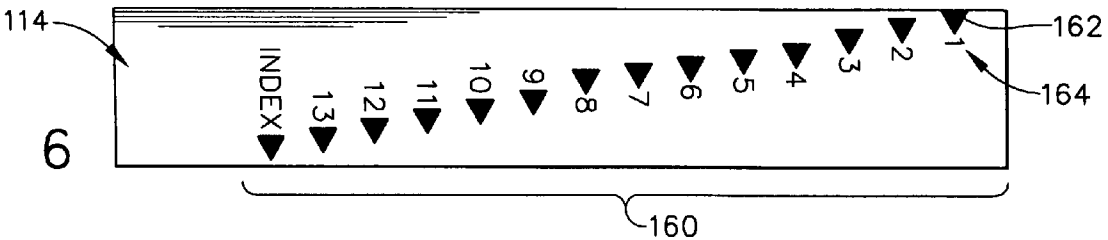
FIG. 6 is a side view of side C for the stack of sheet media of FIG. 2, showing chapter designators as edge data.

Referring now to FIG. 6, the right-hand side 114 is again illustrated, representing a stack of sheet media that has been printed using the principles of the present invention. In FIG. 6, multiple "chapter designators" have been printed, including both a symbol 162 and a number 164. In FIG. 6, the symbol 162 is triangular in shape, and is pointing down. The "top" base of the triangle can represent the first page of each chapter, if desired. Alternatively, the "bottom" tip of the triangle can represent the first page of each margin. This will be determined by the user. Moreover, different symbols can be used, other than triangles, which can also be determined by the user. Finally, the orientation of the triangle symbols could be inverted.

In FIG. 6, there are thirteen (13) different chapters designated along the side 114, and an index designation for the final triangular symbol. As a group, these triangular symbols with numbers and letters are designated by the reference numeral 160. As can be seen when comparing FIGS. 3, 4, and 6, the orientation of the letters and/or numbers can be controlled such that the orientation is similar to a "landscape mode" or to a "portrait mode," similar to conventional print jobs that are well known in the art. This orientation can be referred to as the "side orientation" in reference to the present invention, which refers to the orientation of the letters or numbers with respect to the orientation of the stack 114. In general, the user will likely determine how the stack will be oriented when in use, and when later used, if the stack will normally be lying on a desk surface, the user will probably select the orientation as illustrated in FIGS. 3 and 4. Alternatively, if in later use the stack of papers will normally be placed in a file folder, or stapled or otherwise bound, and then placed on a bookshelf or bookcase, then the user may well decide to select the orientation as depicted in FIG. 6.

The actual images that are printed along the sides of a stack of sheet media can be supplied by the printer manufacturer, if desired, or they can be supplied by the user. If the word LEXMARK is used (as in FIG. 3) in a stack of sheets that is printed by a printer manufactured by Lexmark International, Inc., for example, then that word LEXMARK can comprise graphics data that is supplied by the printer manufacturer, and will be referred to herein as "factory graphics." These factory graphics can be supplied either in the printer firmware, or in the print driver software that is installed on a PC, for example.

On the other hand, if the user supplies the graphics, such as the designation USER A1001 as in FIG. 4, then this will be referred to herein as "user graphics." These graphics supplied by the user may not consist only of alphanumeric characters, but could also include actual images, such as pictures or logos. In general, the user would provide such user graphics by use of the print driver software that is installed on a PC. By arranging the user graphics in this manner, the user can manipulate such graphics using the processing ability of the PC, and then later transfer those graphics to the printer. This can all be done automatically for each individual print job, if the user chooses to set up his or her system in that manner. Alternatively, user graphics can be different for each multi-page print job, and in that situation the user graphics would be individually tailored (by the user) for each individual print job.

Figure 7:
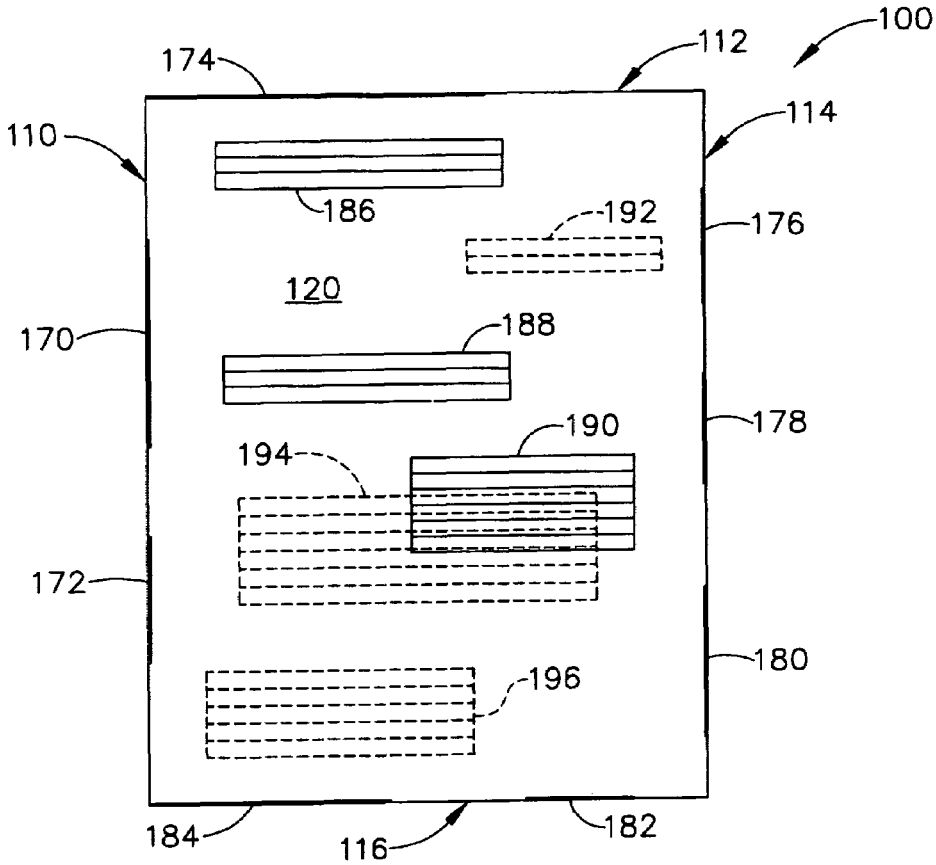
FIG. 7 is a top view of a sheet of print media, showing locations both for face printing data and side printing data for a single sheet of print media, as according to the principles of the present invention.

Referring now to FIG. 7, the top surface 120 of a sheet of print media is visible, as it would appear if placed on the surface of a desk, for example. The four edges can be seen, i.e. the left edge 110, the top edge 112, the right edge 114, and the bottom edge 116. In FIG. 7, there is edge data on each of the four edges, 110, 112, 114, and 116. For example, along the top edge there is a set of edge data 174, and along the right edge there are three different sets of edge data 176, 178, and 180. These various edge data can be at various heights along the stack of individual sheets of print media, if desired. Alternatively, each of the three sets of edge data 176, 178, and 180 could all appear on exactly the same individual sheets of print media, and would all thereby appear at the same height along the side surface 114, when later viewed by a user.

The bottom side 116 has two sets of edge data, 182 and 184. And the left side 110 has two sets of edge data 170 and 172. As before, this edge data can be at various heights on the stack of individual sheets of print media.

FIG. 7 visually demonstrates the capabilities of the present invention, in which the edge data can be placed on more than one edge, and thus can be simultaneously printed on each appropriate sheet of print media in the stack 100. On FIG. 7, there are several areas where text or other image data can be placed on the normal large surfaces or faces of the sheet of media. On the front surface 120, there are three different areas of print data, at 186, 188, and 190. There is also print data on the rear surface of this same sheet of media, and those areas are designated by the reference numerals 192, 194, and 196. This further demonstrates the capabilities of the present invention, in which four edges and two surfaces can be printed on the same sheet of print media. This is a capability not found in conventional printers. Of course, duplex printing is known in the art for printing on the two large surfaces of the same sheet of media. However, additionally printing on one or more of the edges of that same print media is a new capability provided by the present invention. Moreover, five of the six possible locations of printing can be performed in a single print pass through a laser printer or an ink jet printer, for example. This is also a new capability of the present invention.

For the purposes of discussion in this patent document, the printing on the large surfaces will be referred to as "face printing," and the printing along the four edges of the sheet of media will be referred to as "side printing." It is clear from viewing FIG. 7 that the edge data at the positions 170, 172, 174, 176, 178, 180, 182, and 184 are considered side printing. It is also clear that the printing at the positions 186, 188, 190, 192, 194, and 196 is considered face printing.

Figure 8:
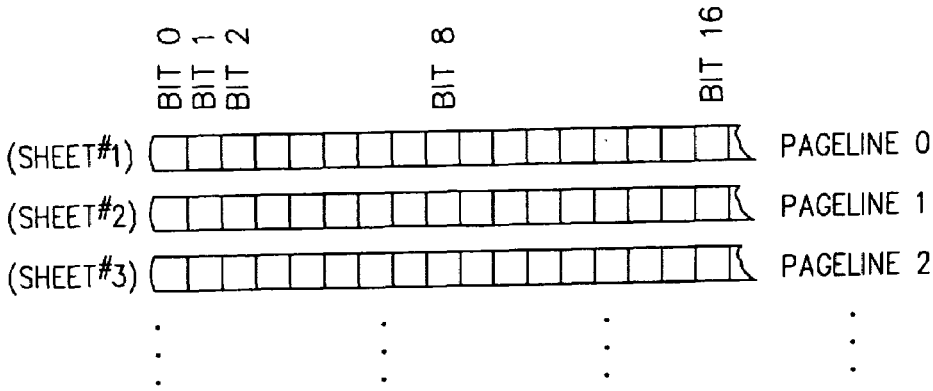
FIG. 8 is a diagrammatic view of bitmap data for certain edge data, in which the first three sheets of a print job have been broken into pageline data, according to the principles of the present invention.

FIG. 8 depicts the actual bitmap print data for three of the sheets of print media along one of the sides. In other words, this is edge data for one of the sides of a stack of print media that is printed according to the principles of the present invention. This could represent any of the areas of edge data that are depicted in FIG. 7, such as the edge data 170, for example.

In FIG. 8, the first (top) sheet has data that is referred to as "PAGELINE 0", while the second sheet has edge data that is referred to as "PAGELINE 1", and the third sheet has edge data that is referred to as "PAGELINE 2". This pageline data is integrated into the "normal" surface print data that is performed as face printing, as defined above. In other words, the pageline data is performed as side printing data, as defined above. Each of the pageline data strings will have multiple bits of print data. On FIG. 8, bits 0 through 16 are depicted for each of the three sheets. If these are the first three sheets in the side of a print job, and if the stack margin for the top portion of this side is more than three sheets, then all of the print data will be blank for these first seventeen bits of each of the three sheets on FIG. 8, and no printed matter (i.e., toner or ink) will appear. This is likely to be a normal situation for many print jobs using the present invention. However, this is not a requirement as noted above, and the stack margins can be zero, for example, if that is what a user desires.

Figure 9:
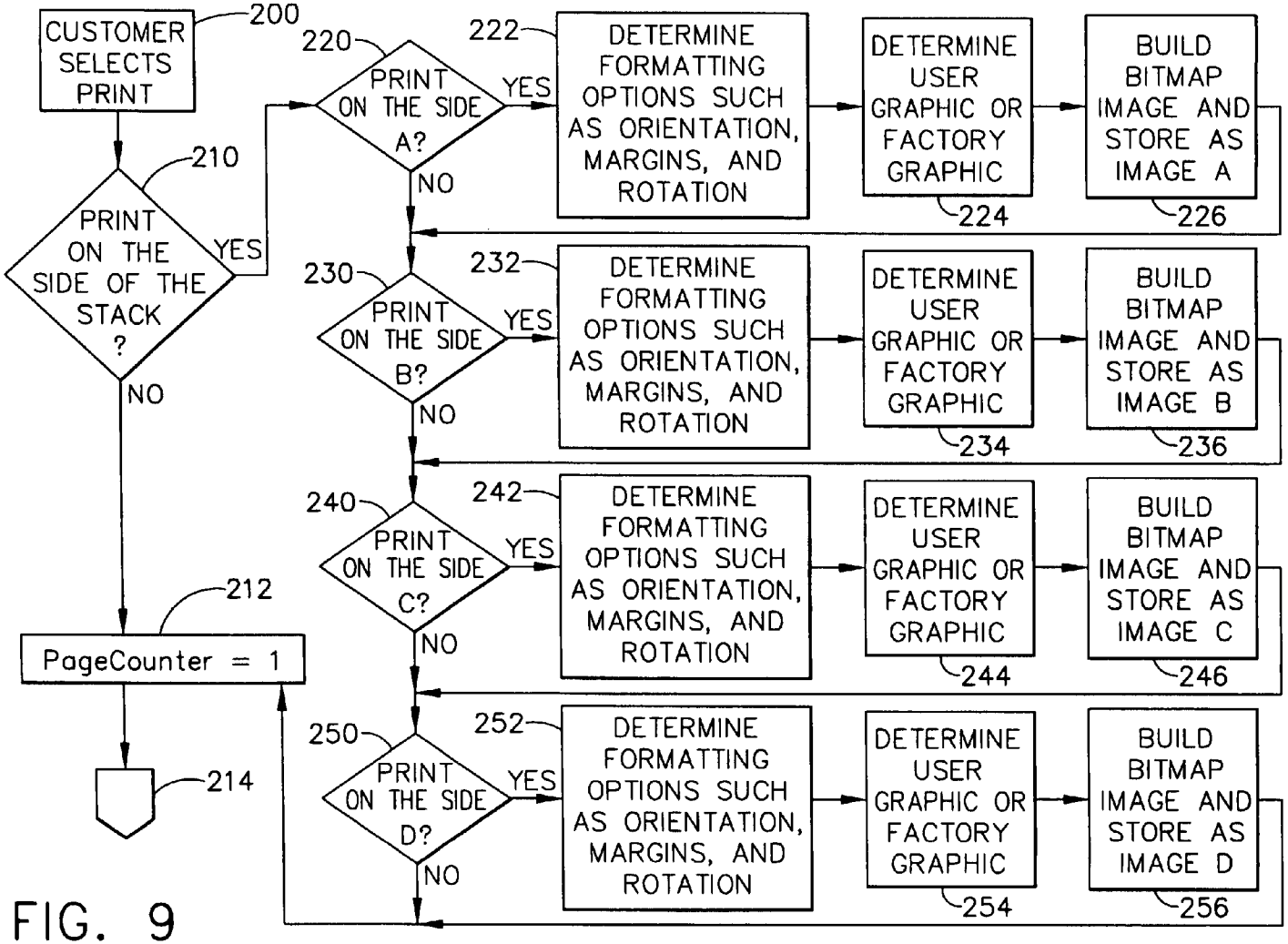
FIG. 9 is a flow chart showing some of the logical operations used in the present invention.

Referring now to FIG. 9, a flow chart of some of the important functions of the present invention is provided. Starting at a step 200, the user or "customer" will select a print job. A decision step 210 determines whether or not the user wishes to print any type of edge data on the side of a multi-page print job. If the answer is NO, then the logic flow travels to a page counter step 212, and the logic flow is directed to an arrow 214 that sends the logic flow to FIG. 10.

Assuming the user has selected some type of edge printing on the side of the stack of sheet media, the logic flow will travel from the YES output of decision step 210 to another decision step 220. At step 220, the system determines if the user wishes to print on side A. If so, a step 222 is executed, which allows the user to determine formatting options, such as the side orientation or placement of the edge data, stack margins, and rotation (side orientation) of the edge data to be printed along the side A.

A step 224 now is executed, where the user can determine whether a factory graphic will be used, or a user-determined graphic. If a user-determined graphic is used, then a step 226 allows the user to build a bitmap image and store it as an image A. This image A will be used as part (or all) of the edge data to be printed on side A. Step 226 allows a user to build a bitmap image if the user has decided to use his or her own user-determined graphic. On the other hand, if a factory graphic is selected, then step 226 will build a bitmap based on that factory graphic. In either case, the bitmap will be built and stored as image A. Image A will be divided into individual pageline data, so that each of the sheets of print media that will be part of this print job will have the appropriate edge data along side A printed when the appropriate sheet passes through the print engine (or printhead) of a laser printer (or ink jet printer), for example.

The logic flow is now directed to a decision step 230, where the system determines whether or not any edge data will be printed on side B. The logic flow would also have arrived here if the user had not selected any edge data for side A. If side B is to have edge data printed thereon, then the user has the same choices as described above for side A. For side B, these are the steps 232, 234, and 236, where the user first determines formatting options, then determines a user-defined graphic or use of a factory graphic, and if a user graphic is used, step 236 allows the user to build the bitmap and store it as image B. The logic flow now is directed to a decision step 240.

After side B has been processed or passed by (depending on the result at step 230), the system now determines whether or not edge data will be printed on side C at step 240. If the answer is YES, then similar functions will be executed at the steps 242, 244, and 246, including the formatting options, the determination of use of a factory graphic or a user-determined graphic, and building a bitmap and storing it as image C. The logic flow is now directed to a decision step 250.

At decision step 250, the system determines whether or not any edge data will be printed on side D. If YES, then steps 252, 254, and 256 will be executed, which will determine the formatting options, determine whether a user-determined graphic or a factory graphic is used, and finally a bitmap image will be built and stored as image D. After this has occurred, the logic flow is directed to the page counter step 212. At this time, all of the edge data will have been processed, and the page counter numeric value will be passed on to the remaining portions of the flow chart, on FIG. 10. If there is no edge data for this particular page, then the logic flow will have traveled from decision step 210 directly to the page counter step 212, and all of the edge data functions will have been completely bypassed for this page (or for the entire print job).

Figure 10:
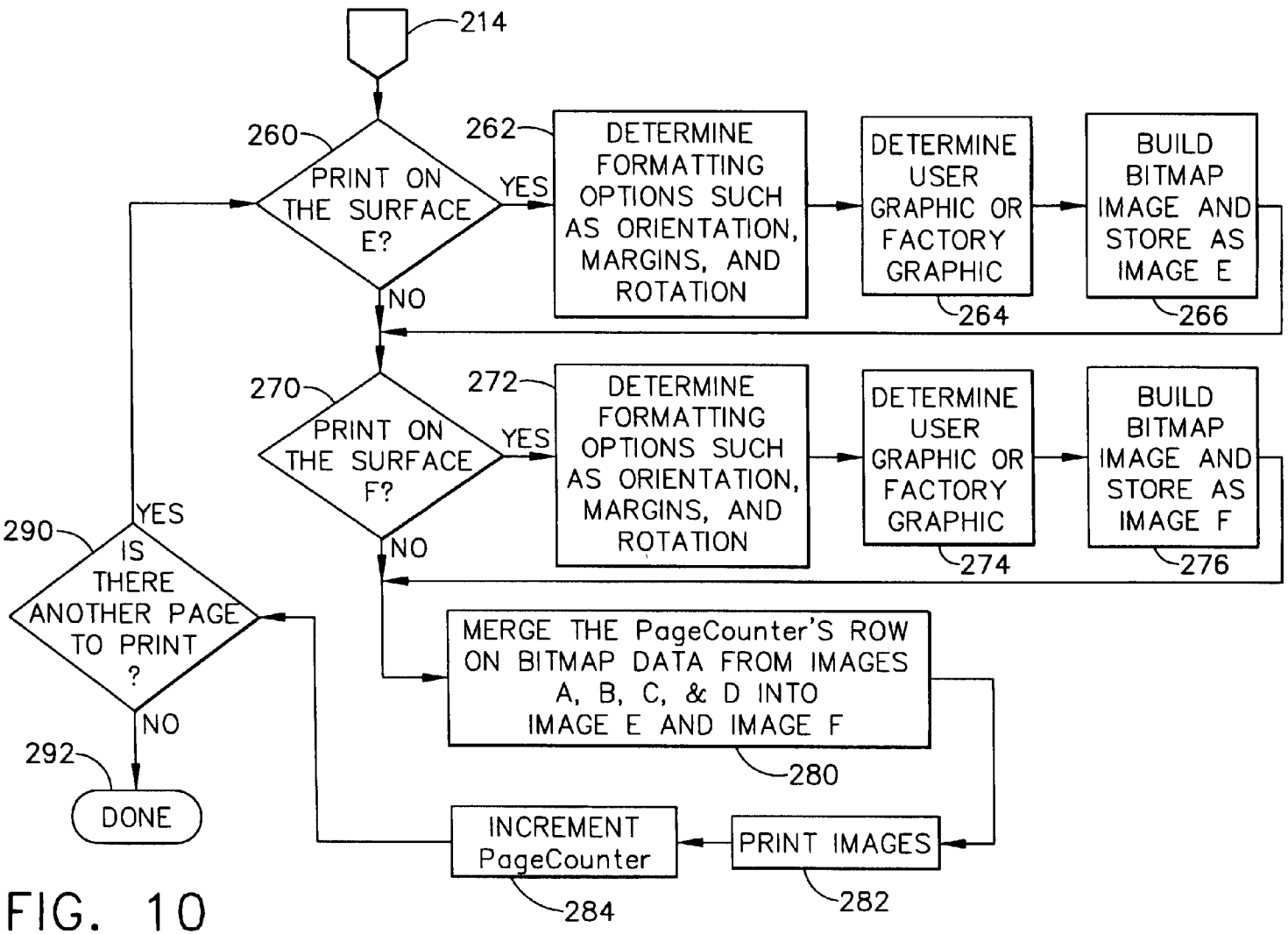
FIG. 10 is a flow chart showing some other of the logical operations used in the present invention.

Referring now to FIG. 10, the logic flow arrives at the symbol 214 from FIG. 9, and is directed to a decision step 260. At step 260, the system determines whether or not any print data will be printed on the surface E. As discussed above in reference to FIG. 2, surface E is the "front" surface of one of the sheets of print media in this multi-page print job. If the answer is NO, the logic flow is directed to a decision step 270. If the answer is YES, then steps 262, 264, and 266 will be executed for this page of sheet media. At step 262, the formatting options will be executed, including orientation of the image data over the various portions of the surface E, the margins of surface E will be determined, and rotation (e.g., landscape or portrait mode) will be determined.

At step 264, the system will determine whether there are any user-determined graphics or factory graphics to be used. If so, that information will be passed to step 266. At step 266, the bitmap image is built and stored as image E. It should be noted that the steps 262, 264, and 266 are essentially well known in the art for printing on any surface of any sheet of print media by any modem printer that receives or builds bitmap images, and prints them.

In a step 270, the system determines whether or not any image data will be printed on the surface F. Referring back to FIG. 2, surface F is the "back" surface of a sheet of print media. Such surfaces can be printed on a duplex-capable printer. If the answer is NO at step 270, then the logic flow is directed to a step 280. If the answer is YES, then steps 272, 274, and 276 will be executed for this sheet of print media in this print job. Step 272 determines the formatting options, as discussed above in reference to step 262. Step 274 determines whether there will be any user-determined graphics or factory graphics used, and step 276 will build the bitmap image and store it as image F. Once again, steps 272, 274, and 276 are well known steps that have been used in modem printers for some time, at least for those that are capable of duplex printing operations.

At this stage in describing the flow charts of FIGS. 9 and 10, it should be noted that the imaging steps for printing on these surfaces E or F are very similar to the imaging steps for printing on the sides A, B, C, or D. In other words, formatting options for each side or surface are executed, the use of user-defined graphics or factory graphics is available for all of the sides or surfaces, and the step of building the bitmap image is performed for all four sides and both surfaces.

In the present invention, the image data for the images A, B, C, and D are integrated into the image data for the surfaces E and F. If, for example, only surface E was going to be printed for a particular sheet of print media, then the image data for images A-D would be integrated with the image data for surface E, so that the entire print job will be executed in one pass through the print engine (or printhead) of a laser printer (or an ink jet printer), for example. On the other hand, if both surfaces of a particular sheet of print media were to be printed, then the side data A-D could be printed in either pass, either for printing the surface E or the surface F, through the print engine (or printhead) of a printer. As a further alternative, side data (or "edge data") could be printed on both surfaces E and F for the same sheet of print media. In that instance, there would be two sets of pageline data for that particular sheet (i.e., one pageline data set for the top surface E and a second pageline data set for the bottom surface F).

It may be preferred that the side data for images A-D always be printed on the surface E pass, if duplex printing is going to be used. However, if only the back or rear surface (i.e., surface F) was going to be printed for a particular sheet of print media, then the edge data for sides A-D would preferably be printed at the same time as the "back" surface F data, so that this sheet would only need one pass through the print engine. In a realistic duplex printer, this particular sheet of print media may have to go through the printhead or print engine twice, even though the front surface E is not to be printed at all. This would be a function of a particular design of a duplex printer, and this "double passthrough" step will not always be necessary for each print job where only the back surface F is to be printed.

The logic flow has now arrived at a step 280, where the page count's row of bitmap data from the images A, B, C, and D are merged into the "surface" bitmap data for images E and F. This is the step where the edge data that has been broken into individual pageline data will be integrated into the "standard" bitmap data for either the front surface (image E) or the rear surface (image F) for each appropriate sheet of the print job. Once this has been accomplished, the images can be printed at a step 282, by directing the sheet of print media through the print engine of a laser printer, or through a printhead of an ink jet printer, for example. A step 284 now increments the page counter value.

The logic flow now is directed to a decision step 290 that determines whether or not there is another page to be printed in this particular print job. If the answer is NO, then this print job is finished, and the logic flow is directed to a "DONE" step 292. On the other hand, if there are more pages, then the logic flow is directed out the YES output from step 290, back toward decision step 260.

The image data for the sides A-D was already determined for all of the sheets of this print job in the logic steps on page 9 of this flow chart. Therefore, the appropriate edge data will be available in memory and waiting until the correct page count has been reached to be integrated into the image data for the surfaces E and/or F. In this manner, the image processing is streamlined for the print job, because all of the edge data is processed at one time, before any of the surface image processing begins. It should be noted, however, that an alternative methodology that is not streamlined in this manner could be implemented, and would still fall within the principles of the present invention.

It will be understood that the term "print media" herein refers to a sheet or roll of material that has toner or some other "printable" material applied thereto by a print engine, such as that found in a laser printer, or other type of electrophotographic printer. Alternatively, the print media represents a sheet or roll of material that has ink or some other "printable" material applied thereto by a print engine or printhead, such as that found in an ink jet printer, or which is applied by another type of printing apparatus that projects a solid or liquified substance of one or more colors from nozzles or the like onto the sheet or roll of material. Print media is sometimes referred to as "print medium," and both terms have the same meaning with regard to the present invention, although the term print media is typically used in this patent document. Print media can represent a sheet or roll of plain paper, bond paper, transparent film (often used to make overhead slides, for example), or any other type of printable sheet or roll material.

It will also be understood that the logical operations described in relation to the flow charts of FIGS. 9-10 can be implemented using sequential logic, such as by using microprocessor technology, or using a logic state machine, or perhaps by discrete logic; it even could be implemented using parallel processors. One preferred embodiment may use a microprocessor or microcontroller (e.g., microprocessor 76) to execute software instructions that are stored in memory cells within an ASIC. In fact, the entire microprocessor 76, along with RAM and executable ROM, may be contained within a single ASIC, in one mode of the present invention. Of course, other types of circuitry could be used to implement these logical operations depicted in the drawings without departing from the principles of the present invention.

It will be further understood that the precise logical operations depicted in the flow charts of FIGS. 9-10, and discussed above, could be somewhat modified to perform similar, although not exact, functions without departing from the principles of the present invention. The exact nature of some of the decision steps and other commands in these flow charts are directed toward specific future models of printer systems (those involving Lexmark printers, for example) and certainly similar, but somewhat different, steps would be taken for use with other models or brands of printing systems in many instances, with the overall inventive results being the same.

As used herein, the term "proximal" can have a meaning of closely positioning one physical object with a second physical object, such that the two objects are perhaps adjacent to one another, although it is not necessarily required that there be no third object positioned therebetween. In the present invention, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

All documents cited in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. A method for printing edge data using a printing apparatus, said method comprising:

(a) providing a sheet printing apparatus having a print media input device, a printing station that applies image-forming material to a sheet of print media that is supplied by said print media input device, and an output pathway that directs said sheet of print media to an output area;

(b) receiving a print job at said sheet printing apparatus from an external computer, said print job including face image data that forms a first bitmap image on a surface of said sheet of print media, said print job also including edge image data that forms a second bitmap image along at least one edge of said surface of the sheet of print media;

(c) integrating said first bitmap image and said second bitmap image into a single overall bitmap image data that is to be used for printing on said surface of the sheet of print media; and (d) moving said sheet of print media from said print media input device to said printing station and, according to said single overall bitmap image data, applying said image-forming material to said surface of the sheet of print media;

wherein:

(e) said second bitmap image is sufficiently small in width along said at least one edge of the sheet of print media that it is not highly visible when viewed from said surface of the sheet of print media; and (f) when said sheet of print media is stacked with other sheets of print media that are printed in the same print job, said second bitmap image forms at least a portion of a side image that is discernable when the stack is viewed from a side.

2. The method as recited in claim 1, wherein a processing circuit controls said moving and applying steps, and a memory circuit stores data used by said processing circuit; and wherein said processing circuit is physically located at one of: (a) said printing apparatus, and (b) a separate computing apparatus.

3. The method as recited in claim 1, wherein said edge image data is generated as a plurality of pagelines of bitmap data, one pageline per each individual sheet of print media of a plurality of sheets in said print job, and each pageline being associated with a different one of said individual sheet of print media in said print job.

4. The method as recited in claim 1, wherein said sheet of print media has four perimeter edges; and further comprising the step of: applying said image-forming material along two, three, or four of said perimeter edges of the sheet of print media, according to said edge image data.

5. The method as recited in claim 1, wherein said sheet printing apparatus further comprises a second output pathway that re-directs said sheet of print media back to said printing station; and further comprising the step of: applying said image-forming material to an opposite surface of said sheet of print media when said sheet of print media passes through said printing station from said second output pathway.

6. The method as recited in claim 5, further comprising the step of: when said image-forming material is applied to said opposite surface of said sheet of print media, forming a second portion of said second bitmap image along at least one edge of said surface of the sheet of print media.

7. The method as recited in claim 6, wherein: said second portion of the second bitmap image is formed on:

(a) a different edge of said surface of the sheet of print media, as compared to the initial portion of the second bitmap image that was printed during the initial application of image-forming material by said printing station; or (b) a same edge of said surface of the sheet of print media, as compared to the initial portion of the second bitmap image that was printed during the initial application of image-forming material by said printing station; or (c) both a same edge and a different edge of said surface of the sheet of print media, as compared to the initial portion of the second bitmap image that was printed during the initial application of image-forming material by said printing station.

8. The method as recited in claim 1, wherein:

(a) at least one of the sheets of print media of said stack of sheets has a first bitmap image formed on its surface, but no second bitmap image along said at least one edge; or (b) at least one of the sheets of print media of said stack of sheets has no first bitmap image on its surface, but has a second bitmap image formed along said at least one edge; or (c) both at least one of the sheets of print media of said stack of sheets has a first bitmap image formed on its surface, but no second bitmap image along said at least one edge, and at least one of the sheets of print media of said stack of sheets has no first bitmap image on its surface, but has a second bitmap image formed along said at least one edge.

9. The method as recited in claim 1, wherein: said discernable side image has at least one side margin, formed according to said edge image data, when said stack is viewed from a side of said sheet of print media.

10. A method for printing edge data using a printing apparatus, said method comprising:

(a) providing a sheet printing apparatus having a print media input device, a, printing station that applies image-forming material to a sheet of print media that is supplied by said print media input device, and an output pathway that directs said sheet of print media to an output area;

(b) receiving a print job at said sheet printing apparatus from an external computer, said print job including face image data that forms a first bitmap image on a surface of said sheet of print media, said print job also including edge image data that forms a second bitmap image along at least two edges of said surface of the sheet of print media; and (c) moving said sheet of print media from said print media input device to said printing station and, in a single pass through said printing station, applying said image-forming material to said surface of the sheet of print media, incorporating both said first and second bitmap images;

wherein:

(d) when said sheet of print media is stacked with other sheets of print media that are printed in the same print job, said second bitmap image forms at least a portion of at least two side images that are discernable when the stack is viewed from a first side and from a second side.

11. The method as recited in claim 10, wherein a processing circuit controls said moving and applying steps, and a memory circuit stares data used by said processing circuit; and wherein said processing circuit is physically located at one of: (a) said printing apparatus, and (b) a separate computing apparatus.

12. The method as recited in claim 10, wherein said edge image data is generated as a plurality of pagelines of bitmap data, one pageline per each individual sheet of print media of a plurality of sheets in said print job, and each pageline being associated with a different one of said individual sheet of print media in said print job.

13. The method as recited in claim 10, wherein:

(a) at least one of the sheets of print media of said stack of sheets has a first bitmap image formed on its surface, but no second bitmap image along said at least two edges; or (b) at least one of the sheets of print media of said stack of sheets has no first bitmap image on its surface, but has a second bitmap image formed along said at least two edges; or (c) both at least one of the sheets of print media of said stack of sheets has a first bitmap image formed on its surface, but no second bitmap image along said at least two edges, and at least one of the sheets of print media of said stack of sheets has no first bitmap image on its surface, but has a second bitmap image formed along said at least two edges.

14. The method as recited in claim 10, wherein: at least one of said discernable side images has at least one side margin, formed according to said edge image data, when said stack is viewed from at least one side of said sheet of print media.

15. A method for printing edge data using a printing apparatus, said method comprising:

(a) providing a sheet printing apparatus having a print media input device, a printing station that applies image-forming material to a plurality of sheets of print media that are supplied by said print media input device, and an output pathway that directs said sheets of print media to an output area;

(b) receiving a print job at said sheet printing apparatus from an external computer, said print job including face image data that forms a first bitmap image on a surface of at least one of said plurality of sheets of print media, said print job also including edge image data that forms a second bitmap image along at least one edge of a surface of at least one of the plurality of sheets of print media;

(c) processing said face image data and said edge image data for said plurality of sheets of print media of said print job; and (d) moving said plurality of sheets of print media from said print media input device to said printing station and, according to said first bitmap image and said second bitmap image, applying said image-forming material to said surface of the plurality of sheets of print media;

wherein:

(e) when said plurality of sheets of print media are stacked with one another, said second bitmap image forms at least a portion of a side image that is discernable when the stack is viewed from a side; and (f) said second bitmap image comprises a design that is determined in real time during said processing step of said print job.

16. The method as recited in claim 15, wherein: said design comprises at least one of:

(a) a factory image provided by a manufacturer of said sheet printing apparatus;

(b) a factory image provided by a third party graphics image supplier; and (c) a user-defined image that was determined by a user of said sheet printing apparatus.

17. The method as recited in claim 15, wherein said design is resident on one of:

(a) a memory device of said sheet printing apparatus;

(b) said external computer directly connected to said sheet printing apparatus; and (c) an external network storage device connected to said sheet printing apparatus through a communications network.

18. The method as recited in claim 15, wherein: said second bitmap image is sufficiently small in width along said at least one edge of one of the plurality of sheets of print media that it is not highly visible when viewed from said surface of one of said sheet of print media.

19. The method as recited in claim 15, wherein a processing circuit controls said moving and applying steps, and a memory circuit stares data used by said processing circuit; and wherein said processing circuit is physically located at one of: (a) said printing apparatus, and (b) a separate computing apparatus.

20. The method as recited in claim 15, wherein said edge image data is generated as a plurality of pagelines of bitmap data, one pageline per each individual sheet of print media of said plurality of sheets of print media in said print job, and each pageline being associated with a different one of said individual sheets of the plurality of sheets of print media in said print job.

21. The method as recited in claim 15. wherein:

(a) at least one of the sheets of print media of said stack of sheets has a first bitmap image formed on its surface, but no second bitmap image along said at least one edge; or (b) at least one of the sheets of print media of said stack of sheets has no first bitmap image on its surface, but has a second bitmap image formed along said at least one edge; or (c) both at least one of the sheets of print media of said stack of sheets has a first bitmap image formed on its surface, but no second bitmap image along said at least one edge, and at least one of the sheets of print media of said stack of sheets has no first bitmap image on its surface, but has a second bitmap image formed along said at least one edge.

22. The method as recited in claim 15, wherein: said discernable side image has at least one side margin, formed according to said edge image data, when said stack is viewed from a side of said plurality of sheets of print media.

* * * * *